US007425107B2

(12) United States Patent
Derache

(10) Patent No.: US 7,425,107 B2
(45) Date of Patent: Sep. 16, 2008

(54) CIVIL ENGINEERING STRUCTURE, INDIVIDUAL CONSTRUCTION ELEMENT AND METHOD FOR REINFORCING SUCH A STRUCTURE

(75) Inventor: Francis Derache, Valence (FR)

(73) Assignee: France Gabion, Valence (FR)

( * ) Notice: Subject to any disclaimer, the term of this patent is extended or adjusted under 35 U.S.C. 154(b) by 737 days.

(21) Appl. No.: 10/954,715

(22) Filed: Sep. 30, 2004

(65) Prior Publication Data

US 2005/0262794 A1 Dec. 1, 2005

(30) Foreign Application Priority Data

Oct. 3, 2003 (FR) ..... 03 50644

(51) Int. Cl.
*E02D 29/02* (2006.01)

(52) U.S. Cl. ..... 405/262; 405/302.7; 405/302.4; 405/284

(58) Field of Classification Search ..... 405/262, 405/284–286, 302.4, 302.7
See application file for complete search history.

(56) References Cited

U.S. PATENT DOCUMENTS

| | | | | | |
|---|---|---|---|---|---|
| 4,904,124 | A | * | 2/1990 | Egan | 405/262 |
| 4,960,349 | A | * | 10/1990 | Willibey et al. | 405/262 |
| 4,992,003 | A | * | 2/1991 | Perach | 405/302.7 |
| 5,076,735 | A | * | 12/1991 | Hilfiker | 405/284 |
| 5,156,495 | A | * | 10/1992 | Mercer | 405/262 |
| 5,161,917 | A | * | 11/1992 | Papetti | 405/284 |
| 5,320,455 | A | | 6/1994 | Mattox | |
| 5,419,659 | A | * | 5/1995 | Mercer | 405/302.7 |
| 5,549,418 | A | * | 8/1996 | Devine et al. | 405/258.1 |
| 5,582,492 | A | * | 12/1996 | Doyle, Jr. | 405/262 |
| 5,636,938 | A | | 6/1997 | Ragazzo | |
| 5,677,016 | A | | 10/1997 | Ferraiolo | |
| 5,795,106 | A | * | 8/1998 | Herd | 405/284 |
| 6,056,479 | A | * | 5/2000 | Stevenson et al. | 405/302.7 |
| 2003/0125425 | A1 | | 7/2003 | Lee | |
| 2003/0156908 | A1 | * | 8/2003 | Liaw | 405/284 |

FOREIGN PATENT DOCUMENTS

| | | | |
|---|---|---|---|
| FR | 2 835 266 | | 8/2003 |
| FR | 2845702 | A1 * | 4/2004 |
| JP | 8-68016 | * | 3/1996 |
| JP | 2005-83068 | * | 3/2005 |

* cited by examiner

*Primary Examiner*—Frederick L Lagman
(74) *Attorney, Agent, or Firm*—Burr & Brown

(57) ABSTRACT

A civil engineering structure, intended for ensuring protection against impacts of moveable masses, has a face exposed to the impacts of moveable masses. The structure includes, in the region of the face exposed to the impacts of moveable masses, a set of individual construction elements secured to one another and filled completely or partially with at least one material having a capacity for being deformed elastoplastically, the individual construction elements liable to be damaged by impacts of moveable masses being capable of being replaced individually by similar individual construction elements.

4 Claims, 3 Drawing Sheets

CIVIL ENGINEERING STRUCTURE, INDIVIDUAL CONSTRUCTION ELEMENT AND METHOD FOR REINFORCING SUCH A STRUCTURE

This application claims the benefit of French Application 03.50644, filed Oct. 3, 2003, the entirety of which is incorporated herein by reference.

The present invention relates to a civil engineering structure ensuring protection against impacts of moveable masses and of projectiles, more particularly of stones. It also relates to an individual construction element intended for the production of protective structures in the field of civil engineering and public works. Another aspect of the invention is concerned with a method for reinforcing a structure ensuring protection against impacts.

PRIOR ART

In mountainous regions and in all steep places, the roads, railway lines and residential areas are often threatened with falls of stones, landslides and slumps coming from cliffs or overhanging slopes. Thus, in spite of regular drainages of cliffs, infrastructures are additionally provided, which are interposed between the zone to be protected and the sources of projectiles.

In order to ensure this protection, various types of equipment are used, in particular reinforced-concrete walls or else nets and grids capable of retaining stones. There are also structures known as "barricades" produced, for example, from sheet-pile cells or else from embankments. These barricades are arranged between the cliff and the zone to be protected, thus defining a trench in which the stones which have fallen from the cliff accumulate. Where high impacts are concerned, the exposed face of the barricades may be deformed and damaged. It was found that these barricades are repaired only very rarely even if they have undergone serious damage.

It is also known, from the document FR-2,835,266, to use worn tyres which are added as the facing of a structure produced from concrete. All these solutions have disadvantages.

The existing concrete structures also have the disadvantage of cracking or of being downright destroyed in the event of impacts by moveable masses having high kinetic energy. Moreover, these infrastructures have much larger dimensions in relation to the actual protection requirements. To be precise, it is extremely difficult to conduct a diagnosis on a damaged barricade. This generally leads to an over dimensioning of the barricade in order to ensure that it fulfills its protective function after one or more high impacts.

As regards the barricade comprising tyres on the exposed face, a repair of such a structure involves the complete renovation of the facing and of the rear reinforced barricade in the impacted zone. This renovation is a cumbersome operation which also has to be carried out in especially hazardous locations subject to stone falls. Furthermore, the addition of elements which seem like refuse gives the structures an aesthetic appearance which is not necessarily acceptable.

Presentation of the Invention

A main problem which the invention proposes to solve is to provide a civil engineering structure which can easily be repaired. A second problem is to design a structure having mechanical properties such that it doesn't require overdimensioning in order to ensure its protective functions. A third problem is to improve the aesthetic and ecological appearance of the structures, whilst at the same time preserving their functional appearance. A fourth problem is to develop an individual construction element capable of limiting the damage undergone by the entire civil engineering structure with which it is associated. A fifth problem is to produce an element which can be prefabricated outside the hazardous zones, that is to say those subject to stone falls. A sixth problem is to implement a method making it possible to reinforce a pre-existing protective structure.

The invention therefore relates to a civil engineering structure intended for ensuring protection against impacts of moveable masses and having a face exposed to the impacts of moveable masses.

According to a first aspect of the present invention, the structure is characterized in that it comprises, in the region of the face exposed to the impacts of moveable masses, a set of individual construction elements secured to one another and filled completely or partially with at least one material having a capacity for being deformed elastoplastically, the individual construction elements liable to be damaged by impacts of moveable masses being capable of being replaced individually by similar individual construction elements.

In other words, by directly producing a protective structure comprising individual elements on the exposed facing, the main contractor can subsequently extract the individual elements damaged by stone impacts from the facing, and it can easily replace them by undamaged individual elements without intervening in the body of the structure. Moreover, due to the presence of these individual elements opposite a cliff, the structure as a whole will benefit from the energy absorption and protection properties. By the elastoplastic deformation of a material is meant a deformation of the material associated with its capacity for recovering its initial form, up to a threshold beyond which the deformation will be permanent.

These individual construction elements may or may not be associated with various types of structures forming the body of the overall structure. Thus, according to a first embodiment, the structure may comprise sheet-pile cells filled with pebbles or with fine materials isolated by means of a geotextile, and a set of individual construction elements arranged on that face of the structure which is exposed to the impacts of moveable masses.

According to a second embodiment, the structure may comprise an embankment reinforced with geotextile sheets or geosynthetic sheets or double-twist gridwork sheets or welded lattices or steel reinforcing bars, and a set of individual construction elements which are arranged on that face of the structure which is exposed to the impacts of moveable masses and which are or are not connected to the reinforcements.

The material having a capacity for being deformed may be selected, alone or in a mixture, from the group which may comprise pieces of shredded tyres, pellets cut from tyres, pieces of polystyrene, earthy materials, sands, gravels, pebbles, crushed recycled concretes, etc. The individual construction elements may have a, first volume of a first material having a capacity for being deformed elastoplastically and a second volume of a second, loose material.

The second, loose material is intended, for example, for aesthetically cladding the outer face and also absorbing part of the energy. The separation between the two volumes may be oriented in a plane substantially perpendicular to the mean direction of arrival of the moveable masses, in order to optimize the absorption of energy during the impacts. By loose materials are meant materials which experience deformation and which assume a given configuration when they are broken into fractions or when they are rearranged.

According to a second aspect of the present invention, each individual construction element, which forms a content delimited by an outer casing, may have a first volume of a first material having a capacity for being deformed elastoplastically and a second volume of a second, loose material, the separation between the two volumes being oriented in a plane substantially perpendicular to the mean direction of arrival of the moveable masses.

In other words, the individual construction and protection element is in two parts or two volumes, each having distinct mechanical properties. The first volume has properties of elastoplasticity with respect to impacts and the second volume has properties of absorption of part of the energy of the impacts. The moveable masses arrive at the structure in a preferential arrival and impact direction. The mean statistical arrival direction of these moveable masses is taken into account, in the knowledge that random rebounds and trajectories of moveable masses may occur. In many instances, the parting plane between the two volumes is substantially vertical.

The first material having the capacity for being deformed may be selected, alone or in a mixture, from the group comprising pieces of shredded tyres, pellets cut from tyres, pieces of polystyrene, earthy materials, sands, gravels, pebbles, crushed recycled concretes, etc. The second, loose material may be selected, alone or in a mixture, from the group which may comprise topsoil, sands, gravels, pebbles, rock blocks, crushed concrete, etc.

The outer casing may consist of a cage of a metal sheet-pile cell, and, if appropriate, the cage may be covered internally with a geotextile material. The separation between the volume of the material having the capacity for being deformed and the volume of loose material may be implemented by means of a wall made from a geotextile material or from gridwork or from a metal lattice, etc.

The individual construction element may likewise comprise a multiplicity of volumes, in succession a volume of loose material and a volume of first material having a capacity for being deformed elastoplastically. The separation between the volumes may be oriented respectively in a plane substantially perpendicular to the mean arrival direction of the moveable masses.

According to another aspect of the invention, a civil engineering structure, intended for ensuring protection against impacts of moveable masses and having a face exposed to the impacts of moveable masses, is characterized in that it comprises at least one element, as described above.

According to a third aspect of the present invention, a method for reinforcing a civil engineering structure, intended for ensuring protection against impacts of moveable masses, is characterized in that it comprises the steps involving:

positioning, in the region of the face exposed to the impacts of moveable masses, a set of individual construction elements which form a content delimited by an outer casing and which are filled completely or partially with at least one material having a capacity for being deformed elastoplastically; and securing the said individual construction elements to one another, so as to make it possible to replace individually the individual construction elements damaged by impacts of moveable masses with similar individual construction elements.

By virtue of the invention, any impact against the face will touch only one or more individual construction elements, without affecting the structural intactness of the structure.

BRIEF DESCRIPTION OF THE FIGURES

The invention will be understood clearly and its various advantages and different characteristics will become more apparent from the following description of the non-limiting exemplary embodiment, with reference to the accompanying diagrammatic drawings in which.

DETAILED DESCRIPTION OF THE INVENTION

Figure 1:
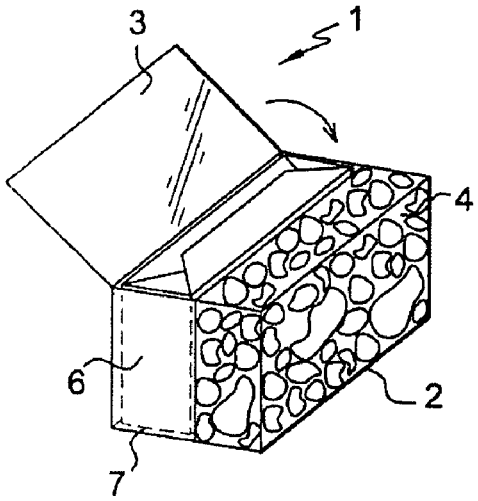
FIGS. 1 to 4 illustrate perspective views of four different embodiments of an individual element.

As illustrated in FIG. 1, an individual construction element (1) may take the form of a substantially parallelepipedal sheet-pile cell. The sheet-pile cell comprises an outer metal cage (2) produced, for example, from double-twist gridwork or from welded lattice work. The cage (2) may be closed by means of a lid (3). The sheet-pile cells are used for producing protective structures or for reinforcing existing structures.

According to one aspect of the invention, and in a first embodiment (see FIG. 1), the cage (2) has two distinct volumes (4 and 6). A first volume (4) is located at the front of the cage (2) with respect to the closing hinge of the lid (3). A second volume (6) is located at the rear of the cage (2) with respect to the closing hinge of the lid (3).

The first volume at the front (4) contains loose materials, by way of example pebbles, sands, gravels or topsoil. The second volume located at the rear (6) contains materials having elastoplastic properties, such as, for example, pellets or granules based on shredded tyres. The first volume at the front (4) is oriented, on the protective structure, on the same side as the face exposed to impacts.

Tyre granules obtained by means of the method described in the document FR-2,804,061 may be used. As an example, the pellets used may have dimensions of the order of a centimetre. The shredded tyres are held with the aid of a casing (7) produced, for example, from a geotextile material. A temporary geomat may also form the separation between the loose materials and the elastoplastic materials.

It will be noted that, depending on the desired function, the arrangement of the two volumes (4 and 6) may be reversed, as compared with the first embodiment of FIG. 1. The first volume containing loose materials (4) may be arranged at the rear and the second volume containing materials having elastoplastic properties (6) may be arranged at the front on the same side as that face of the protective structure which is exposed to impacts.

In a second embodiment (see FIG. 2), the cage (2) likewise has the same two distinct volumes (4 and 6). However, the front face (5) exposed to impacts has an inclination, for example substantially equal to 45° with respect to the horizontal. Such an inclined front face (5) will allow a much easier establishment of plants, thus giving the cage (2) and the entire structure obtained by means of this type of cage (2) a much more attractive aesthetic and ecological appearance.

In a third embodiment (see FIG. 3), the cage (2) has a single volume (8). This single volume (8) contains materials having elastoplastic properties, such as, for example, shredded tyres, which are retained by means of a casing (7) produced, for example, from a geotextile material.

In a fourth embodiment (see FIG. 4), the cage (2) has three distinct volumes (9, 11 and 12). A first volume (9) is located at the front of the cage (2), in this case with respect to the closing hinge of the lid (3). A second volume (11) is located at the rear of the cage (2), in this case with respect to the closing hinge of the lid (3). A third volume (12) is interposed in a central position between the first volume at the front (9) and the second volume at the rear (11). The first volume at the front (9) and the second volume at the real (11) contain loose materials, by way of example pebbles, sand, gravels or topsoil. The third, central volume (12) contains materials having elastoplastic properties, such as, for example, shredded tyres, which are retained by means of a casing (7) produced, for example, from a geotextile material.

Figure 5:
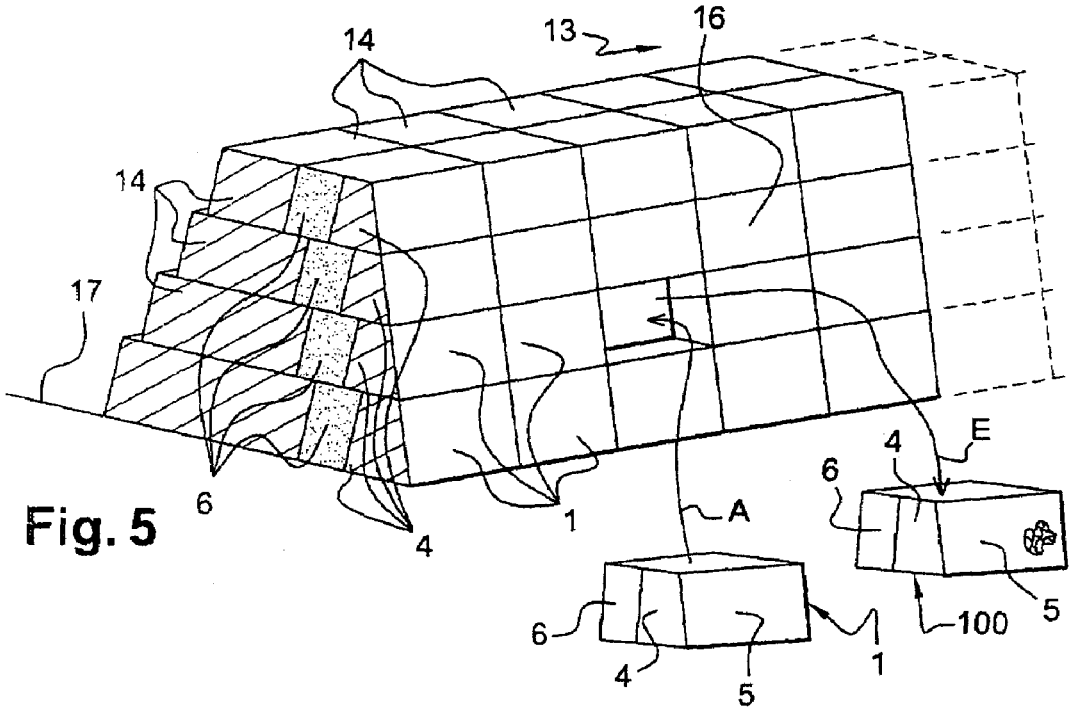
FIG. 5 illustrates a perspective view of a protective structure produced from individual elements.

FIG. 5 illustrates a protective structure (13) which is formed from a first stack of metal sheet-pile cells (14) secured to one another. These sheet-pile cells (14) are filled with materials of the stone or rock type. The structure (13) is oriented so as to have a vertical or inclined face which is more particularly exposed to falls of stones or other landslides. This structure (13) protects a road (17) and/or residences located at the bottom of the other flank of the structure (13), on the opposite side to the exposed face.

Figure 2:
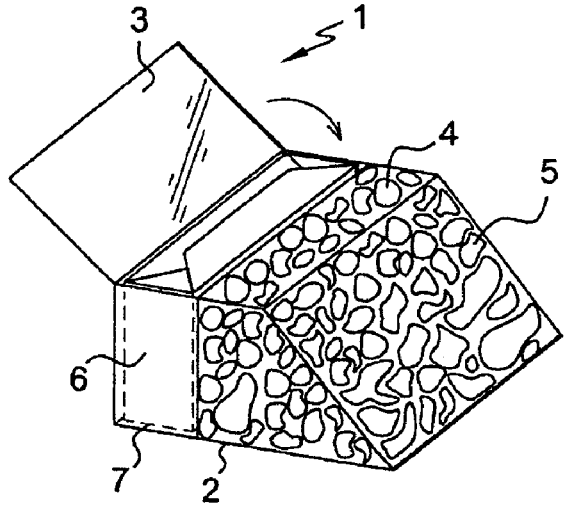

According to one aspect of the invention, the structure (13) comprises a facing (16) produced from removeable characteristic individual construction elements. In this example, sleet-pile cells having an inclined front face (1) and conforming to the second embodiment of FIG. 2 are used. These sheet-pile cells (1) are arranged with respect to one another and with respect to the conventional sheet-pile cells of the stack (14), in such a way as to have their first volume with loose material (4) on the exposed front face and to have their second volume with elastoplastic material (6) at the rear and against the sheet-pile cells of the stack (14).

According to another aspect of the invention, the sheet-pile cells of the facing (1) are easily removable and can be replaced if they are damaged. Thus, the method for repairing a civil engineering structure (13) may comprise the steps involving:

determining the individual construction element or individual construction elements, filled with a material having a capacity for being deformed elastoplastically, which are damaged by impacts of moveable masses and which are to be repaired or replaced (100);

emptying this or these individual construction elements (100).

As regards the individual construction elements to be repaired, that is to say those which have undergone a local impact on the front face over a small area, extracting that front face of the grid work which is damaged, by cutting it out;

replacing this front face with an intact front face by binding or stapling, care having been taken, where appropriate, to complete the filling materials.

With regard to the individual construction elements to be replaced, that is to say those having undergone a very high impact which, for example, has damaged the entire front face, extracting (arrow E in FIG. 5) from the civil engineering structure (13) these damaged individual construction elements (100) without contact with the other undamaged individual construction elements (1);

adding (arrow A in FIG. 5) intact individual construction elements (1) in place of the damaged individual construction elements (100).

Figure 6:
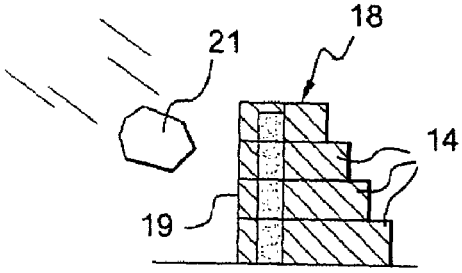
FIGS. 6 to 14 illustrate cross-sectional views of nine different embodiments of protective structures.

Various methods of protective assembly may be carried out on structures. Thus, in a first embodiment (FIG. 6), a structure (18) with a stack of sheet-pile cells (14) comprises a protective facing (19) which is produced by means of sheet-pile cells according to the first embodiment of FIG. 1. The structure (18) has a substantially vertical face exposed to the falls of stones (21). This structure (18) may likewise be produced by means of a stack of conventional sheet-pile cells filled with materials normally selected for a structure according to the prior art and of sheet-pile cells filled solely with elastoplastic materials according to the third embodiment of FIG. 3.

Figure 7:
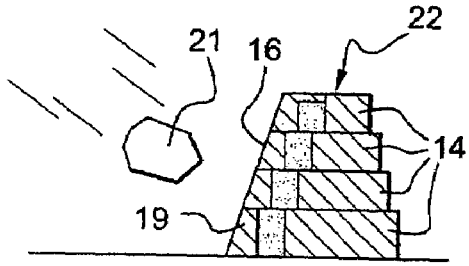

In a second embodiment (see FIGS. 5 and 7), the structure (22) includes a solid structure formed from a stack of sheet-pile cells (14). It comprises, furthermore, a protective facing (19) which is produced by means of sheet-pile cells according to the second embodiment of FIG. 2. The structure (22) has an inclined face (16) which is exposed to the falls of stones (21) and which may be established with plants.

Figure 3:
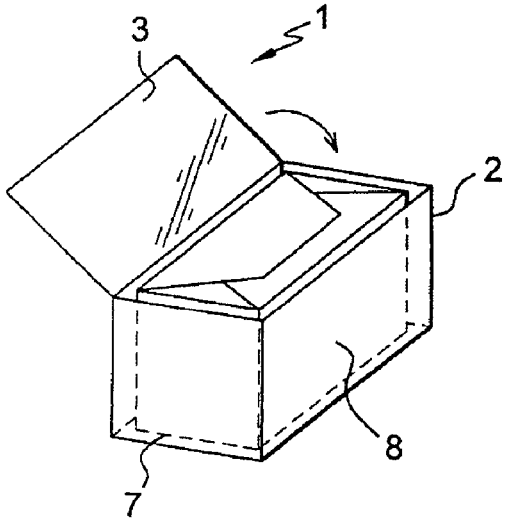
Figure 8:
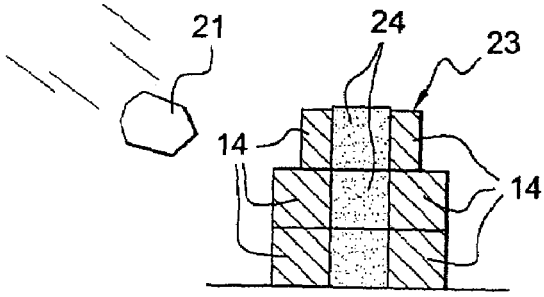

In a third embodiment (see FIG. 8), the structure (23) includes a stack of sheet-pile cells (14) and comprises a central protective core (24) which is produced by means of sheet-pile cells according to the third embodiment of FIG. 3. The stack of conventional sheet-pile cells (14), filled with materials normally selected for a structure according to the prior art, are located on either side of the stack of protective sheet-pile cells (25).

Figure 4:
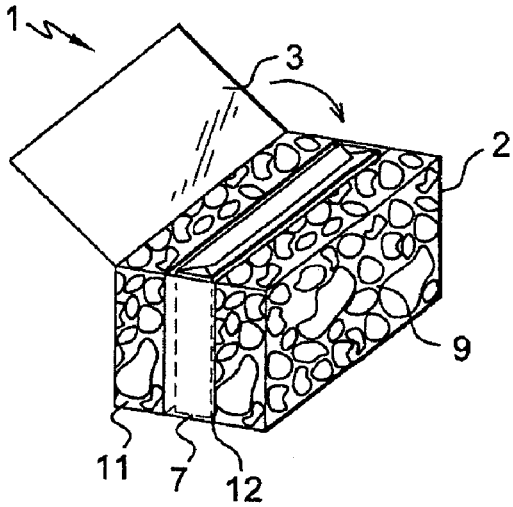
Figure 9:
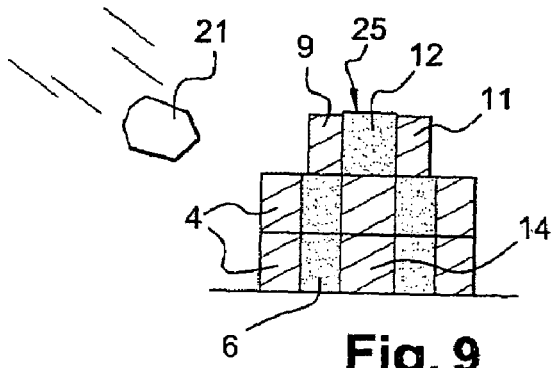

In a fourth embodiment (see FIG. 9), the structure (25) includes a stack of sheet-pile cells according to the first embodiment of FIG. 1 and according to the fourth embodiment of FIG. 4. This embodiment may also be constructed from an alternation of sheet-pile cells filled with materials normally selected for a structure according to the prior art and of sheet-pile cells according to the third embodiment of FIG. 3.

Figure 10:
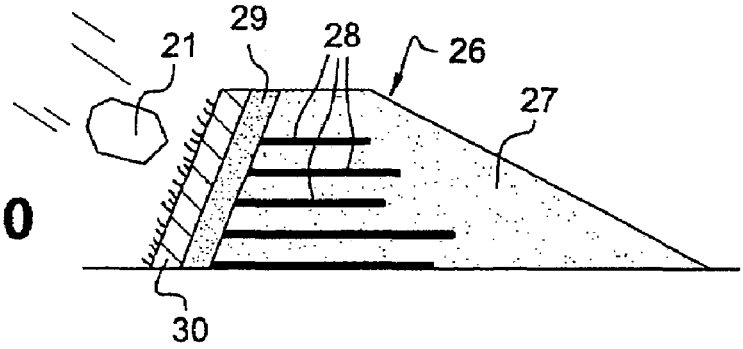

In a fifth embodiment (see FIG. 10), the structure (26) has a solid structure formed by an embankment (27), for example consisting of earth, reinforced uniformly over its entire height with reinforcing sheets (28) in geotextile or geosynthetic form or in the form of metal latticework or gridwork. The reinforcing sheets (28) extend only over part of the thickness of the embankment (27). An inclined protective facing (29), which is or is not secured to the main structure of the structure, is produced by means of a plurality of longitudinal elements in one piece which conform to the first embodiment of FIG. 1 or to the third embodiment of FIG. 3. The outer part (30) of the facing (29) may consist of pebbles or of topsoil or of a soil/pebble mixture which is then established with plants.

Figure 11:
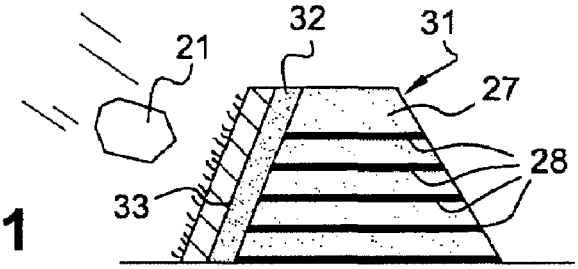

In a sixth embodiment (see FIG. 11), the structure (31) likewise comprises an embankment (27), consisting, for example, of earth, reinforced uniformly over its entire height with reinforcing sheets (28) in geotextile or geosynthetic form or in the form of metal latticework or gridwork. The reinforcing sheets (28) in this case extend over the entire thickness of the embankment (27). The stability of the two faces is ensured. An inclined protective facing (32) is produced by means of a plurality of longitudinal elements in one piece which conform to the third embodiment of FIG. 3. The outer part of the facing (32) may consist of pebbles or of topsoil or of a soil/pebble mixture (33) which is then established with plants.

Figure 12:
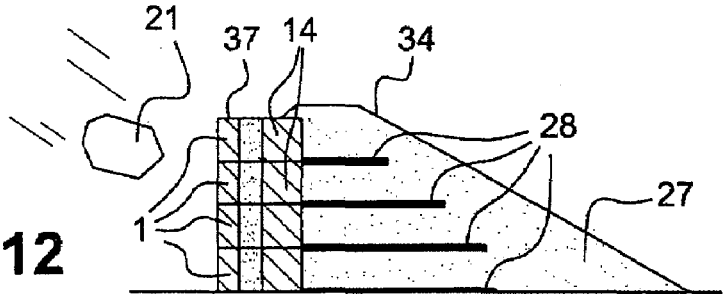

In a seventh embodiment (see FIG. 12), the structure (34) is an embankment (27), consisting, for example, of earth, reinforced uniformly over its entire height with reinforcing, sheets. (28) in geotextile or geosynthetic form or in the form of metal latticework or gridwork, which extend only over part of the thickness of the embankment (27), so as to ensure the stability of the slope. The local stability of one of the faces is ensured with the aid of sheet-pile cells (14) filled with materials normally selected for a structure according to the prior art. A protective facing (27) is produced by means of sheet-pile cells (1) according to the first embodiment of FIG. 1.

Figure 13:
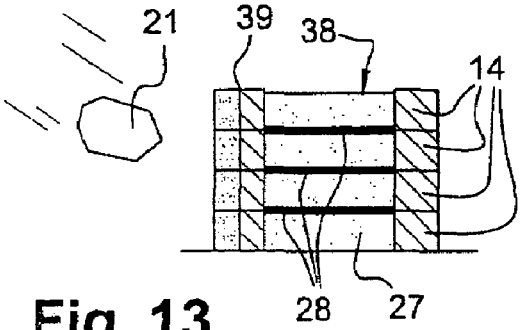

In an eighth embodiment (see FIG. 13), the structure (38) consists of a vertical stack of sheet-pile cells (14) filled with materials normally selected for a structure according to the prior art, the said stack being laid against an embankment (27) reinforced with reinforcing sheets (28) in geotextile or geosynthetic form or in the form of metal latticework or gridwork, extending over the entire thickness of the embankment (27), so as to ensure the stability of the slope on either side. A substantially vertical protective facing (39) is produced by means of sheet-pile cells according to the first embodiment of FIG. 1, but inverted, with their front volume filled with elastoplastic materials.

Figure 14:
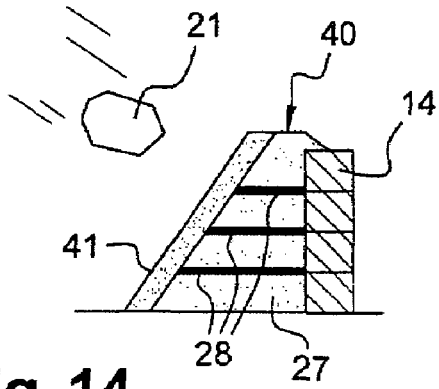

In a ninth embodiment (see FIG. 14), the structure (40) consists of a vertical stack of sheet-pile cells (14) which is laid against an embankment (27) reinforced with geotextile or geosynthetic sheets (28) or metal latticework or gridwork, extending over the entire thickness of the embankment (27), so as to ensure the stability of the slope on either side. An inclined protective facing (41), substantially similar to the facings of the fifth and sixth embodiments of structures (see FIGS. 10 and 11), is produced by means of a plurality of longitudinal elements in one piece which conform to the first embodiment of FIG. 1.

The present invention is not limited to the embodiments described and illustrated. Many modifications may be made, without thereby departing from the framework defined by the scope of the set of claims.

The dimensions of the protective sheet-pile cells may be highly variable as a function of the desired protective structure. Other uses may be considered, such as protective structures in the military field or structures for the reinforcement of banks of canals, streams, rivers and seashores, where the moveable masses are objects transported by the flow of water, or even traffic routes for the protection of vehicles from impacts.

The invention claimed is:

1. A civil engineering structure intended for ensuring protection against impacts of moveable masses, said structure comprising a plurality of individual construction elements arranged to form a plurality of courses, each course including a plurality of said individual construction elements, each of said individual construction elements comprising:

an outer metal cage having a front face exposed to the impacts of moveable masses and a back face opposite said front face, said front face corresponding to an exposed surface of said engineering structure and said back face corresponding to an interior of said engineering structure;

first and second distinct interior volumes located within said metal cage, said first distinct interior volume being adjacent said front face, and said second distinct interior volume being adjacent said back face;

loose materials provided in said first distinct interior volume, said loose materials being at least one of topsoil, sands, gravels, pebbles, rock blocks and crushed concrete;

deformable materials having a capacity for being deformed elastoplastically provided in said second distinct interior volume, said deformable materials being at least one of shredded tires, pellets cut from tires, pieces of polystyrene, earthy materials, sands, gravels, pebbles or crushed recycled concretes, wherein the individual construction elements located within intermediate courses of said structure are capable of being replaced individually by a similar individual construction elements.

2. The structure according to claim 1, further comprising a pluraliy of sheet-pile cells filled with pebbles or fine materials isolated by means of a geotextile, said sheet-pile cells being located adjacent said individual construction elements along said back face thereof.

3. The structure according to claim 1, further comprising an embankment reinforced with geotextile sheets, geosynthetic sheets, double-twist gridwork sheets, welded lattices or steel reinforcing bars, wherein said embankment is located on a side of said individual construction elements facing said back face.

4. A method for reinforcing a civil engineering structure intended for ensuring protection against impacts of moveable masses, said method comprising:

providing a plurality of outer metal cages, each metal cage having a front face exposed to the impacts of movable masses and a back face opposite said front face and having first and second distinct interior volumes, said first distinct interior volume being adjacent said front face and said second distinct interior volume being adjacent said back face;

filling said first interior volume with loose materials, said loose materials being at least one of topsoil, sands, gravels, pebbles, rock blocks and crushed stone;

filling said second interior volume with deformable materials having a capacity for being deformed elastoplastically, said deformable materials being at least one of shredded tires, pellets cut from tires, pieces of polystyrene, earthy material, sands, gravels, pebbles, or crushed recycled concretes;

providing a plurality of said outer metal cages having the first and second distinct interior volumes filled, each of said filled outer metal cages being an individual construction element;

arranging said individual construction elements to form a plurality of courses, each course including a plurality of said individual construction elements; and securing the said individual construction elements to one another so as to make it possible to individually replace the individual construction elements damaged by impacts of moveable masses with similar individual construction elements.

* * * * *